US009478131B2

(12) United States Patent
Eichhorst

(10) Patent No.: US 9,478,131 B2
(45) Date of Patent: Oct. 25, 2016

(54) PRIORITIZATION OF TRAFFIC SIGNAL PREEMPTION REQUESTS RECEIVED FROM MULTIPLE SOURCES OVER DIFFERENT COMMUNICATION MEDIUMS

(75) Inventor: Kevin Eichhorst, Owatonna, MN (US)

(73) Assignee: Global Traffic Technologies, LLC, St. Paul, MN (US)

( * ) Notice: Subject to any disclaimer, the term of this patent is extended or adjusted under 35 U.S.C. 154(b) by 778 days.

(21) Appl. No.: 12/684,442

(22) Filed: Jan. 8, 2010

(65) Prior Publication Data

US 2011/0169661 A1 Jul. 14, 2011

(51) Int. Cl.
*G08G 1/07* (2006.01)
*G08G 1/087* (2006.01)

(52) U.S. Cl.
CPC ..... *G08G 1/087* (2013.01)

(58) Field of Classification Search
CPC ..... G08G 1/087
USPC ..... 340/906
See application file for complete search history.

(56) References Cited

U.S. PATENT DOCUMENTS 5,187,476 A * 2/1993 Hamer ..... G08G 1/087 340/901
5,202,683 A 4/1993 Hamer et al.
5,539,398 A * 7/1996 Hall ..... G08G 1/087 340/906
5,602,739 A 2/1997 Haagenstad et al.
5,955,968 A * 9/1999 Bentrott ..... G08G 1/087 340/7.2
5,986,575 A * 11/1999 Jones ..... G08G 1/087 340/906
6,064,319 A 5/2000 Matta
6,243,026 B1 * 6/2001 Jones ..... G08G 1/07 340/906
6,985,090 B2 1/2006 Ebner et al.
7,248,183 B2 * 7/2007 Pfleging ..... G08G 1/0965 340/686.1
7,307,547 B2 12/2007 Schwartz
7,333,028 B2 2/2008 Schwartz
7,417,560 B2 8/2008 Schwartz
7,620,812 B2 * 11/2009 Sikora ..... H04B 10/112 340/5.2
8,054,202 B1 * 11/2011 Sikora ..... G08G 1/087 340/902
2005/0175072 A1 * 8/2005 Mack ..... H04B 1/707 375/146
2006/0143451 A1 6/2006 Sikora et al.
2006/0273923 A1 * 12/2006 Schwartz ..... G08G 1/0965 340/906
2006/0273926 A1 * 12/2006 Schwartz ..... G08G 1/087 340/907
2009/0189782 A1 * 7/2009 Bachelder ..... G08G 1/087 340/906

* cited by examiner

*Primary Examiner* — Naomi Small
(74) *Attorney, Agent, or Firm* — Crawford Maunu PLLC

(57) ABSTRACT

Approaches for prioritizing multiple candidates for preemption of a traffic signal phase at an intersection are disclosed. Light signals transmitted from light-signaling vehicles approaching an intersection encode priority codes using a first set of values. Radio signals from radio-signaling vehicles approaching the intersection encode priority codes using a second set of values. A set of preemption candidates is determined from the light and radio signals, as well as from network-based requests, and a respective relative priority of each preemption candidate based on the priority code of each preemption candidate is determined. A request output for preemption of the traffic signal phase for a preemption candidate having a highest priority.

19 Claims, 6 Drawing Sheets

PRIORITIZATION OF TRAFFIC SIGNAL PREEMPTION REQUESTS RECEIVED FROM MULTIPLE SOURCES OVER DIFFERENT COMMUNICATION MEDIUMS

FIELD OF THE INVENTION

The present invention is generally directed to servicing preemption requests for traffic control signals.

BACKGROUND

Traffic signals have long been used to regulate the flow of traffic at intersections. Generally, traffic signals have relied on timers or vehicle sensors to determine when to change traffic signal lights, thereby signaling alternating directions of traffic to stop, and others to proceed.

Emergency vehicles, such as police cars, fire trucks and ambulances, generally have the right to cross an intersection against a traffic signal. Emergency vehicles have in the past typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

Traffic control preemption systems assist authorized vehicles (police, fire and other public safety or transit vehicles) through signalized intersections by making a preemption request to the intersection controller. The controller will respond to the request from the vehicle by changing the intersection lights to green in the direction of the approaching vehicle. This system improves the response time of public safety personnel, while reducing dangerous situations at intersections when an emergency vehicle is trying to cross on a red light. In addition, speed and schedule efficiency can be improved for transit vehicles.

There are presently a number of known traffic control preemption systems that have equipment installed at certain traffic signals and on authorized vehicles. One such system in use today is the OPTICOM® system. This system utilizes a high power strobe tube (emitter), which is located in or on the vehicle, that generates light pulses at a predetermined rate, typically 10 Hz or 14 Hz. A receiver, which includes a photodetector and associated electronics, is typically mounted on the mast arm located at the intersection and produces a series of voltage pulses, the number of which are proportional to the intensity of light pulses received from the emitter. The emitter generates sufficient radiant power to be detected from over 2500 feet away. The conventional strobe tube emitter generates broad spectrum light. However, an optical filter is used on the detector to restrict its sensitivity to light only in the near infrared (IR) spectrum. This minimizes interference from other sources of light.

Intensity levels are associated with each intersection approach to determine when a detected vehicle is within range of the intersection. Vehicles with valid security codes and a sufficient intensity level are reviewed with other detected vehicles to determine the highest priority vehicle. Vehicles of equivalent priority are selected in a first come, first served manner. A preemption request is issued to the controller for the approach direction with the highest priority vehicle travelling on it.

Another common system in use today is the OPTICOM GPS priority control system. This system utilizes a GPS receiver in the vehicle to determine location, speed and heading of the vehicle. The information is combined with security coding information that consists of an agency identifier, vehicle class, and vehicle ID and is broadcast via a proprietary 2.4 GHz radio.

An equivalent 2.4 GHz radio located at the intersection along with associated electronics receives the broadcasted vehicle information. Approaches to the intersection are mapped using either collected GPS readings from a vehicle traversing the approaches or using location information taken from a map database. The vehicle location and direction are used to determine on which of the mapped approaches the vehicle is approaching toward the intersection and the relative proximity to it. The speed and location of the vehicle is used to determine the estimated time of arrival (ETA) at the intersection and the travel distance from the intersection. ETA and travel distances are associated with each intersection approach to determine when a detected vehicle is within range of the intersection and therefore a preemption candidate. Preemption candidates with valid security codes are reviewed with other detected vehicles to determine the highest priority vehicle. Vehicles of equivalent priority are selected on a first come, first served manner. A preemption request is issued to the controller for the approach direction with the highest priority vehicle travelling on it.

With metropolitan wide networks becoming more prevalent, additional means for detecting vehicles via wired networks such as Ethernet or fiber optics and wireless networks such as Mesh or 802.11b/g may be available. With network connectivity to the intersection, vehicle tracking information may be delivered over a network medium. In this instance, the vehicle location is either broadcast by the vehicle itself over the network or it may broadcast by an intermediary gateway on the network that bridges between, for example, a wireless medium used by the vehicle and a wired network on which the intersection electronics resides. In this case, the vehicle or an intermediary reports, via the network, the vehicle's security information, location, speed and heading along with the current time on the vehicle, intersections on the network receive the vehicle information and evaluate the position using approach maps as described in the Opticom GPS system. The security coding could be identical to the Opticom GPS system or employ another coding scheme.

SUMMARY

The various embodiments of the invention provide various approaches for prioritizing multiple candidates for preemption of a traffic signal phase at an intersection. In one embodiment a method includes receiving a respective light signal transmitted from one or more light-signaling vehicles approaching an intersection. Each respective light signal encodes a priority code using a first set of values. Respective radio signals are received from one or more radio-signaling vehicles approaching the intersection. Each respective radio signal encodes respective location data and encodes a respective priority code using a second set of values. A set of preemption candidates is determined from each respective light signal and respective radio signal. A respective relative priority of each preemption candidate is determined based on the priority code of each preemption candidate. A request for preemption of the traffic signal phase is output for a preemption candidate having a highest priority.

In another embodiment, a system is provided for prioritizing multiple candidates for preemption of a traffic signal phase at an intersection. The system includes means for receiving a respective light signal transmitted from one or more light-signaling vehicles approaching an intersection. Each respective light signal encodes a priority code using a first set of values. Means are provided for receiving a respective radio signal from one or more radio-signaling vehicles approaching the intersection. Each respective radio signal encodes respective location data and encodes a respective priority code using a second set of values. The system further includes means for receiving a respective message packet from one or more network-coupled vehicles approaching the intersection. Each respective message packet encodes respective location data and encodes a respective priority code using the second set of values. Means are provided for determining a set of preemption candidates from each respective light signal, respective radio signal, and respective message packet. Means are also provided for determining a respective relative priority of each preemption candidate based on the priority code of each preemption candidate. The system further includes means for outputting a request for preemption of the traffic signal phase for a preemption candidate having a highest priority.

In yet another embodiment, a traffic signal preemption control system comprises photo-detector circuitry for receiving a respective light signal transmitted from one or more light-signaling vehicles approaching an intersection. Each respective light signal encodes a priority code using a first set of values. A radio signal receiver is provided for receiving a respective radio signal from one or more radio-signaling vehicles approaching the intersection. Each respective radio signal encodes respective location data and encodes a respective priority code using a second set of values. A processor is coupled to the photo-detector circuitry and to the radio signal receiver. A memory is coupled to the processor, and the memory is configured with instructions for programming the processor to perform the operations including determining a set of preemption candidates from each respective light signal and respective radio signal, determining a respective relative priority of each preemption candidate based on the priority code of each preemption candidate, and outputting a request for preemption of the traffic signal phase for a preemption candidate having a highest priority.

The above summary of the present invention is not intended to describe each disclosed embodiment of the present invention. The figures and detailed description that follow provide additional example embodiments and aspects of the present invention.

BRIEF DESCRIPTION OF THE DRAWINGS

Other aspects and advantages of the invention will become apparent upon review of the Detailed Description and upon reference to the drawings in which.

DETAILED DESCRIPTION

Figure 1:
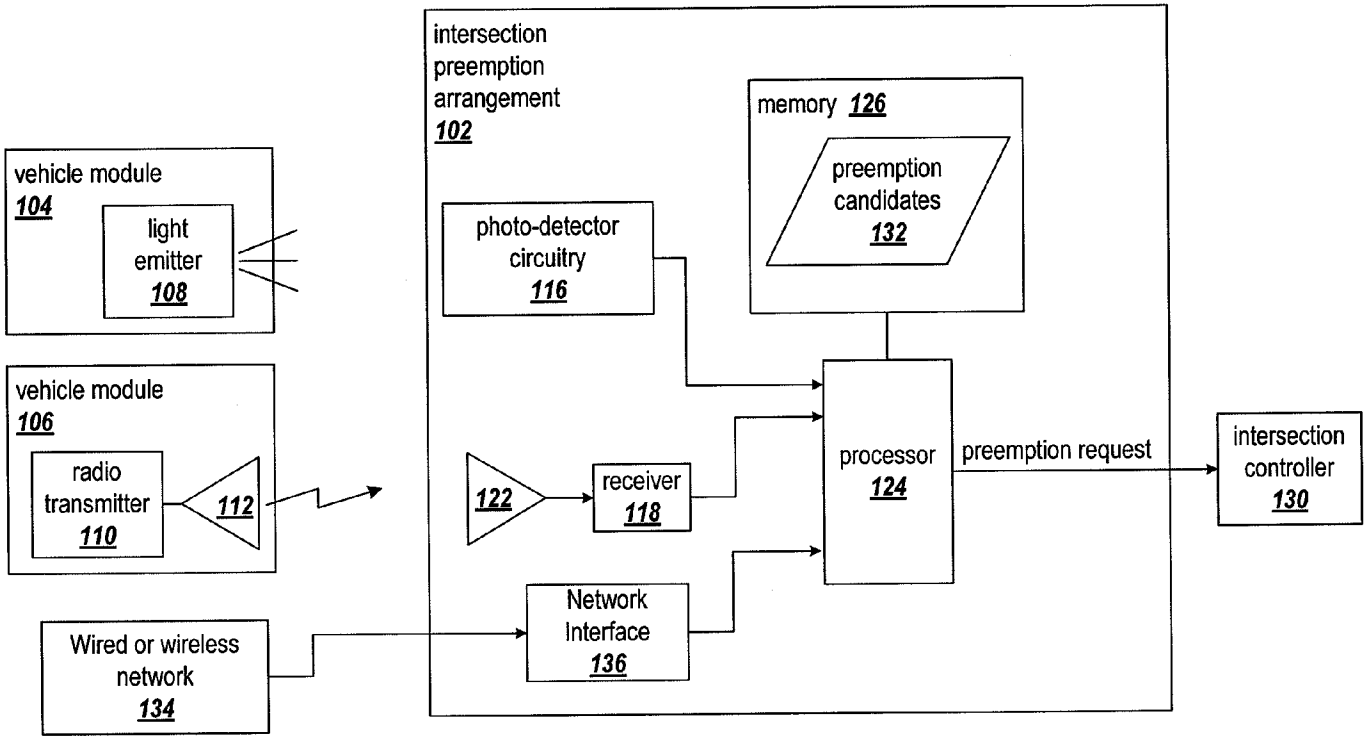
FIG. 1 is a block diagram showing different types of devices that issue preemption requests and the control mechanism for processing those preemption requests in accordance with an embodiment of the invention.

The embodiments of the present invention service preemption requests from devices that use different technologies to issue the preemption requests. For example, preemption requests received from IR light emitters, requests received via radio wave signal in a GPS-based system, and requests received via a wired or wireless network are serviced. The ability to service requests from multiple types of systems supports mutual aid environments and also mitigates the costs of upgrading systems from one technology to another.

Neighboring municipalities often arrange to provide mutual aid in emergency situations. However, in some instances the neighboring municipalities may employ different preemption control systems, which would not allow emergency vehicles in one municipality to preempt a traffic signal in a neighboring municipality. With embodiments of the present invention, selected intersections may be upgraded, for example those at or near the borders of municipalities, to recognize preemption requests from different types of sources. Thus, mutual aid may be enhanced without having to upgrade every vehicle with the same technology.

The embodiments of the present invention also provide a cost-effective way to upgrade an existing IR emitter-based preemption system to a newer GPS-based system. Instead of having to upgrade every intersection and an entire fleet of vehicles, including police, fire, and transit vehicles, for example, IR detectors may be left in place at selected intersections, while other intersections may be upgraded to accommodate IR emitters, GPS equipment, and network equipment. As more intersections are converted to accommodate these types of technology, the municipality can begin to upgrade more vehicles in the fleet to use the GPS equipment.

An example situation in which staging an upgrade of preemption control systems is beneficial involves the growing use of transit signal priority as an aid in maintaining bus schedules and reducing fuel consumption and/or emissions in congested traffic. Transit signal priority allows lower priority vehicles, such as buses, to receive additional signal time during a current green phase. Some traffic controllers have the ability to extend an active green phase to allow the bus to pass through the intersection. A few extra seconds of the green phase eliminates the need for the bus to stop, idle and wait for the full traffic signal cycle to complete, and then accelerate from a dead stop back to speed, possibly at a rate to make up for lost time. For a municipality that has existing IR installations and would like to equip their buses with GPS equipment, the municipality need only upgrade the buses and intersections used by the buses to provide service to both transit and organizations having vehicles with IR emitters.

The embodiments of the present invention allow mixed detection methods to be used in support of system migrations. Existing installed equipment using one signaling technology and newer equipment that uses a different vehicle signaling technology may be used in combination. In one embodiment, a method prioritizes multiple candidates for preemption of a traffic signal phase at an intersection, where the preemption candidates originate from different signaling technologies. A preemption control module receives a respective light signal transmitted from one or more light-signaling vehicles approaching an intersection. Each respective light signal encodes a priority code. The preemption control module receives a respective radio signal from one or more radio-signaling vehicles approaching the intersection, and each respective radio signal encodes respective location data and a respective priority code. The preemption control module determines a set of preemption candidates from each respective light signal and respective radio signal and determines a respective relative priority of each preemption candidate based on the priority codes. A request for preemption of the traffic signal phase is output for the preemption candidate having the highest priority.

FIG. 1 is a block diagram showing different types of devices that issue preemption requests and the control mechanism for processing those preemption requests in accordance with an embodiment of the invention. An intersection preemption arrangement 102 receives and processes preemption request signals from vehicle modules 104 and 106 and is disposed at an intersection. The vehicle modules may be disposed in vehicles authorized to preempt traffic signals in a given jurisdiction. The preemption request signal from vehicle module 104 is a light signal from light emitter 108, and the preemption request signal from vehicle module 106 is a radio signal from radio transmitter 110 and antenna 112. Examples of the vehicle modules 104 and 106 are those of the OPTICOM emitter-based system and the OPTICOM GPS priority control system.

The intersection preemption arrangement 102 includes both photo-detector circuitry 116 and radio receiver 118 with antenna 122, which are coupled to processor 124. The processor is further coupled to memory 126. Preemption requests are provided by the intersection preemption arrangement to the intersection controller 130, which controls the phases (the phases including a green phase, a yellow phase, and a red phase, for example) of the traffic signal. The physical disposition of the components at the intersection may vary according to implementation requirements. For example, the photo-detector circuitry 116, receiver 118, and antenna 122 may be disposed in a housing mounted to the structure (not shown) that supports the traffic signal, and the processor and memory may be separately mounted along with the intersection controller 130 in a separate housing. Alternatively, the processor and memory may be disposed with the photo-detector circuitry, receiver, and antenna 122 on the signal support structure.

The photo-detector circuitry 116 senses the light signal from light emitter 108 and provides a preemption request to the processor 124 when the light signal strength indicates that the vehicle module is within a suitable range of the intersection and intersection preemption arrangement. The receiver 118 receives the radio signal from radio transmitter 110 and provides the preemption request to the processor. The wired or wireless network 134 delivers message packets containing preemption requests sent by network-coupled vehicles or intermediary entities. The network interface 136 receives these packets and provides the preemption request to the processor. In response to a preemption request received via photo-detector circuitry or the radio receiver, the processor determines whether or not the vehicle module is within a desired range of the intersection. If the module is within the desired range, the preemption request is added to a set of preemption candidates 132. For the light signal-based preemption request, the strength of the signal indicates whether or not the vehicle module 104 is within the desired range. The radio signal from the module 106 contains location data that indicates the GPS coordinates of the vehicle module, and the processor checks whether or not those GPS coordinates are within the desired range. The message packets from the network interface 136 contain location data that indicates the GPS coordinates of the vehicle module, and the processor checks whether or not those GPS coordinates are within the desired range.

The processor 124 is configured to select one preemption candidate from the set of preemption candidates for signaling a preemption request to the intersection controller 130. The selection of the preemption candidate is made based on a variety of factors such as relative priorities, ages of the requests, and the approach of an in-progress preemption request in combination with the approaches associated with the preemption candidates. The selection process is described in further detail in FIGS. 4-1-4-3.

In an example embodiment the photodetector circuitry 116 may be similar to that used in the OPTICOM emitter-based system, and the radio receiver 118 and antenna 122 may be the OPTICOM GPS priority control system.

In an example implementation, the processor 124 employs a 32-bit RISC architecture with onboard communications peripherals for Ethernet networking, Universal Serial bus (USB), and serial communications. The processor includes both onboard random-access memory (RAM) and Flash memory for program storage. Additional RAM and Flash memory are available as external peripherals to the processor. The photo-detector circuitry 116 interfaces to the microprocessor via individual timer/capture inputs to detect and time the arrival of pulses from an emitter. The amplitude of the signal is measured using an analog-to-digital converter. The radio receiver is connected to the processor via a high-speed, serial peripheral interface (SPI) bus. The network interface consists of a physical layer module external to the processor and the onboard Ethernet interface.

Figure 2:
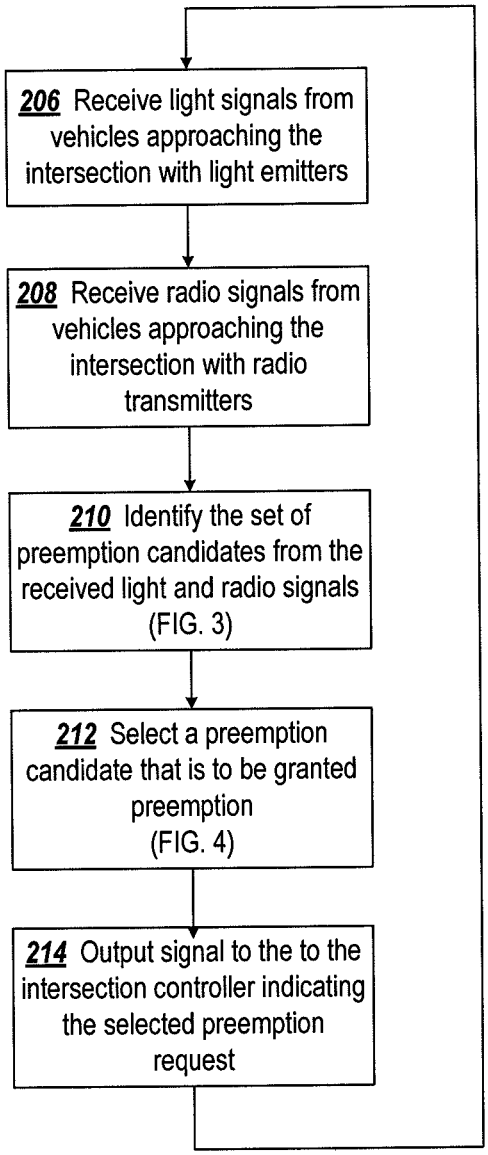
FIG. 2 is a flowchart of an example process for processing preemption requests from different types of requesters in accordance with one embodiment of the invention.

FIG. 2 is a flowchart of an example process for processing preemption requests from different types of requesters in accordance with one embodiment of the invention. The process entails receiving preemption requests via light signals from vehicles having light emitters (step 206) and receiving preemption requests via radio signals from vehicles having radio transmitters (step 208).

Figure 3:
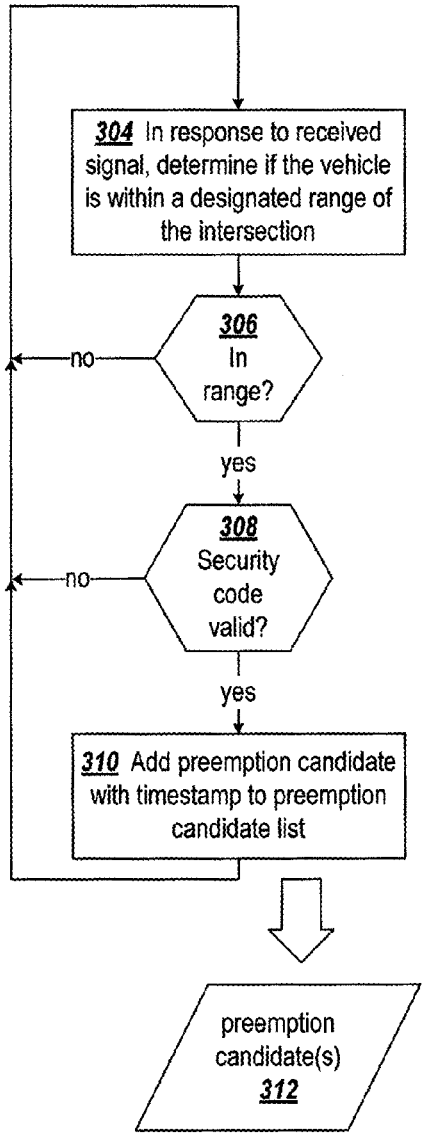
FIG. 3 is a flowchart of an example process for determining whether or not a received preemption request will be considered as a candidate for preempting the traffic signal phase.

At step 210, the process identifies which of the received preemption requests is eligible to be considered a preemption candidate. In an example embodiment, in order to be considered as a preemption candidate, the source of the preemption request must be in range and also have a valid security code. FIG. 3 describes in additional detail a process for determining whether or not a preemption request is eligible to be a preemption candidate.

At step 212, a preemption candidate is selected to be granted preemption. The factors used in selecting the preemption candidate include, for example, relative priorities, ages of the requests, and the approach of an in-progress preemption request in combination with the approaches of the preemption candidates. At step 214, a signal is output to the intersection controller to indicate preemption is requested on the approach associated with the selected preemption candidate.

FIG. 3 is a flowchart of an example process for determining whether or not a received preemption request will be considered as a candidate for preempting the traffic signal phase. At step 304, the process determines whether or not the source of the received preemption request signal is within a designated range of the intersection. As described above, for a light emitter-based preemption request the strength of the light signal will indicate whether or not the source of the preemption request is within range, and for a GPS-based preemption request the GPS coordinates will indicate whether or not the source of the preemption request is within range.

In an example implementation, the range is configured by the user during installation to fit the topography of the intersection approaches and the predominant speed at which vehicles will travel toward the intersection. Optical systems are specified in terms of light intensity level and may be configured through a special means whereby an emitter configured with a special code may be activated at the threshold distance and the measured intensity is used as the range setting. GPS based systems use either a distance measurement or an estimated time of arrival (ETA). Either range setting must take into account clearing times for pedestrian crossing and signal transition time to allow drivers and pedestrians adequate time to react to the signal changes.

If the source is not within the designated range, decision step 306 returns to step 304 for processing of any additionally received requests. Otherwise, decision step 308 determines whether or not the security code of the preemption request is valid. In one embodiment the security code for a preemption request is a vehicle identifier associated with the source vehicle module and transmitted via the preemption request signal. The embodiments of the present invention accommodate different sets of vehicle identifiers used in different systems. For example, in the OPTICOM light emitter-based system, the vehicle identifier range is 0-999, and in the OPTICOM GPS-based system, the vehicle identifier range is 1-9999. The embodiments of the present invention recognize the superset of these ranges as vehicle identifiers. A vehicle module submitting a preemption request with a vehicle identifier outside this superset is not eligible to have its preemption request considered. In addition, the processor 120 may be configured to execute program code that excludes certain preemption requests from being considered as preemption candidates if those preemption requests have certain ones of the vehicle identifiers in the superset.

If the security code is valid, the preemption request is added to the set of preemption candidates 312 with an associated timestamp at step 310. Otherwise, the process returns to step 304 for processing of any additionally received requests.

Figure 4:
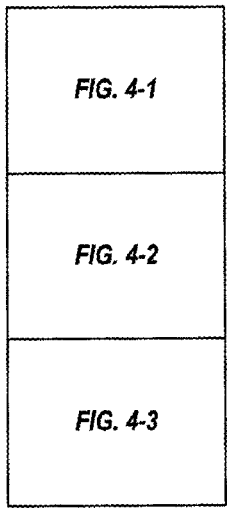
FIG. 4 shows the relationship between FIGS. 4-1, 4-2, and 4-3, which together form a flowchart of an example process for selecting one preemption candidate from multiple preemption candidates to preempt the traffic signal phase in accordance with an embodiment of the invention.
Figures 1, 4:
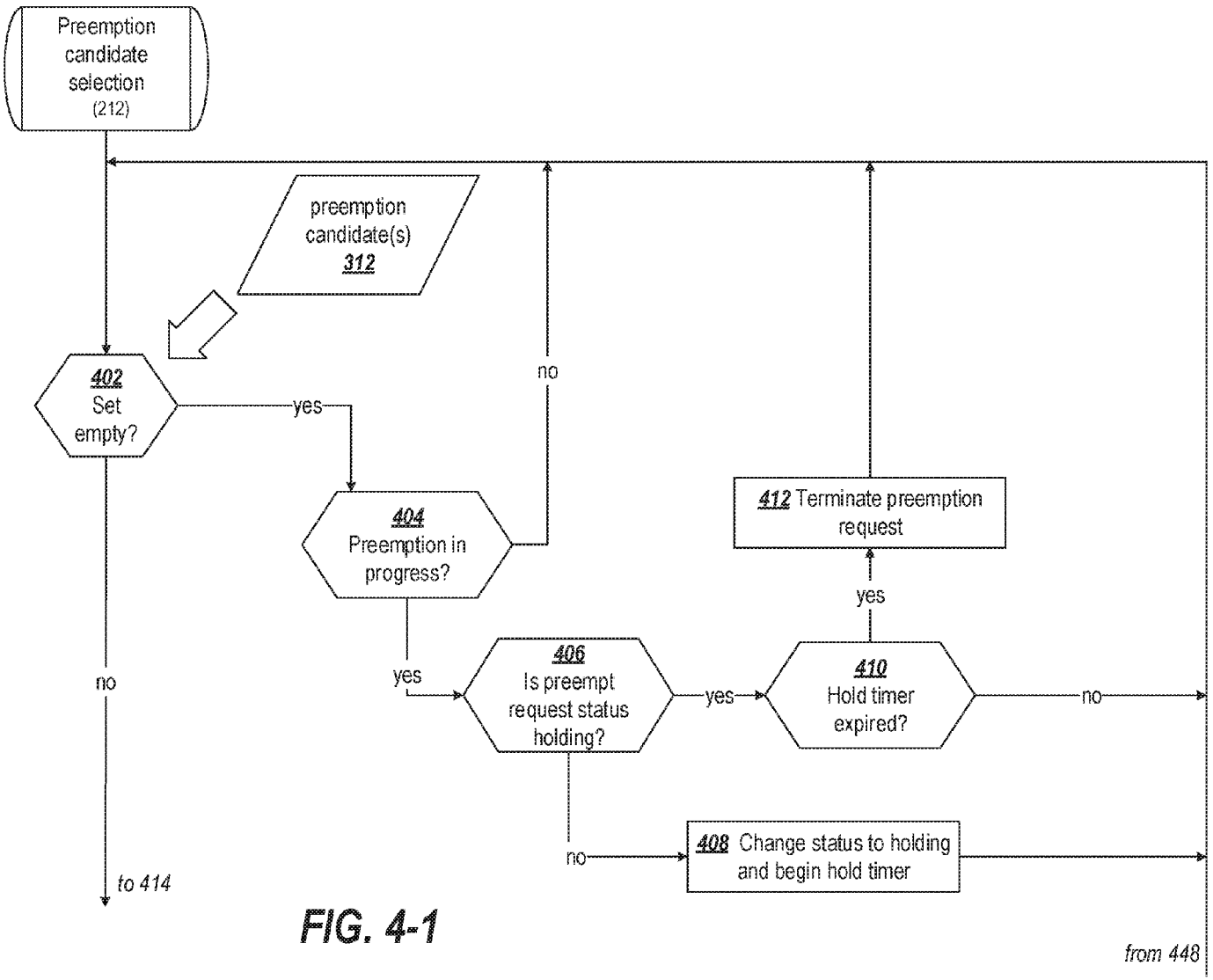
Figures 2, 4:
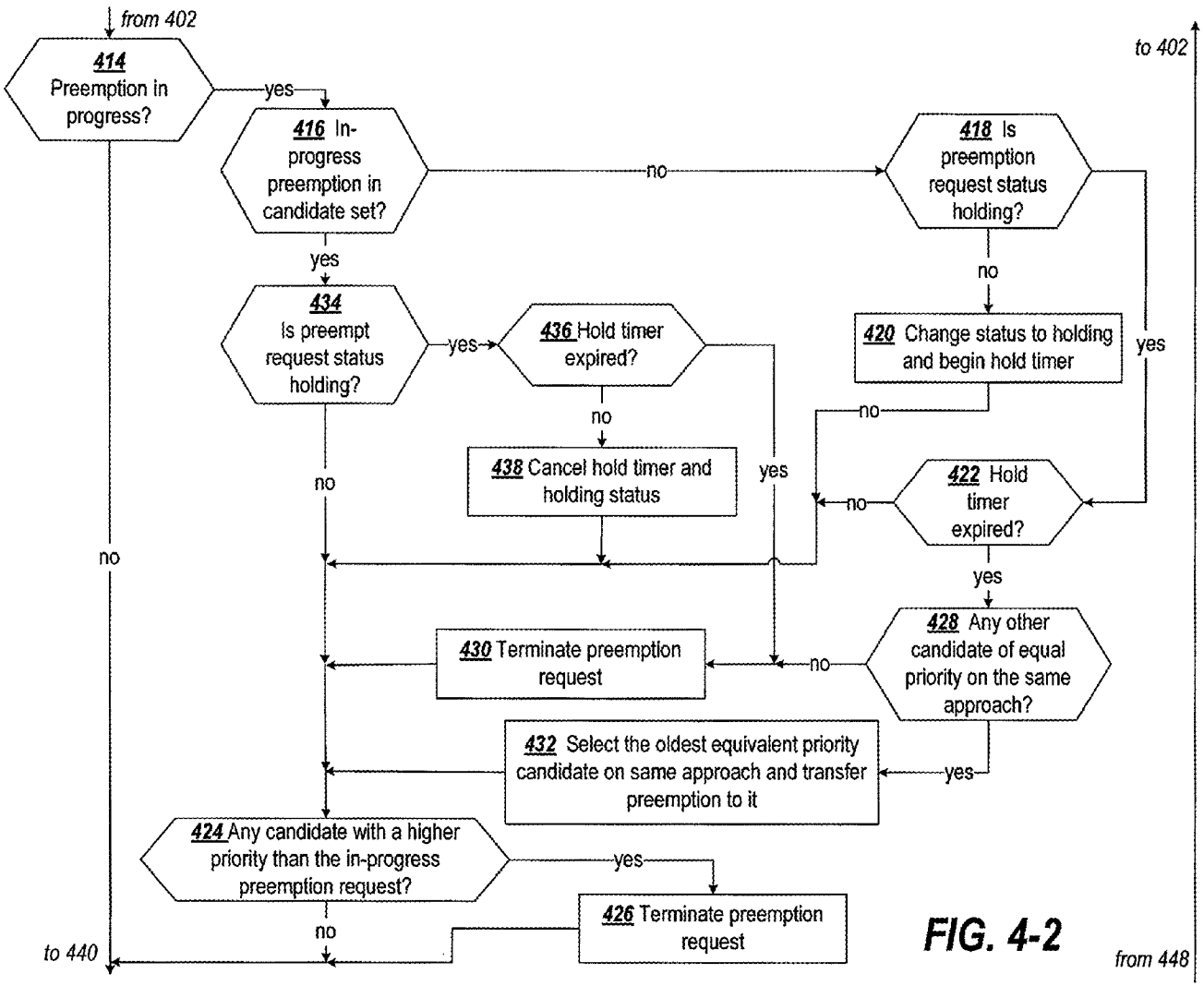
Figures 3, 4:
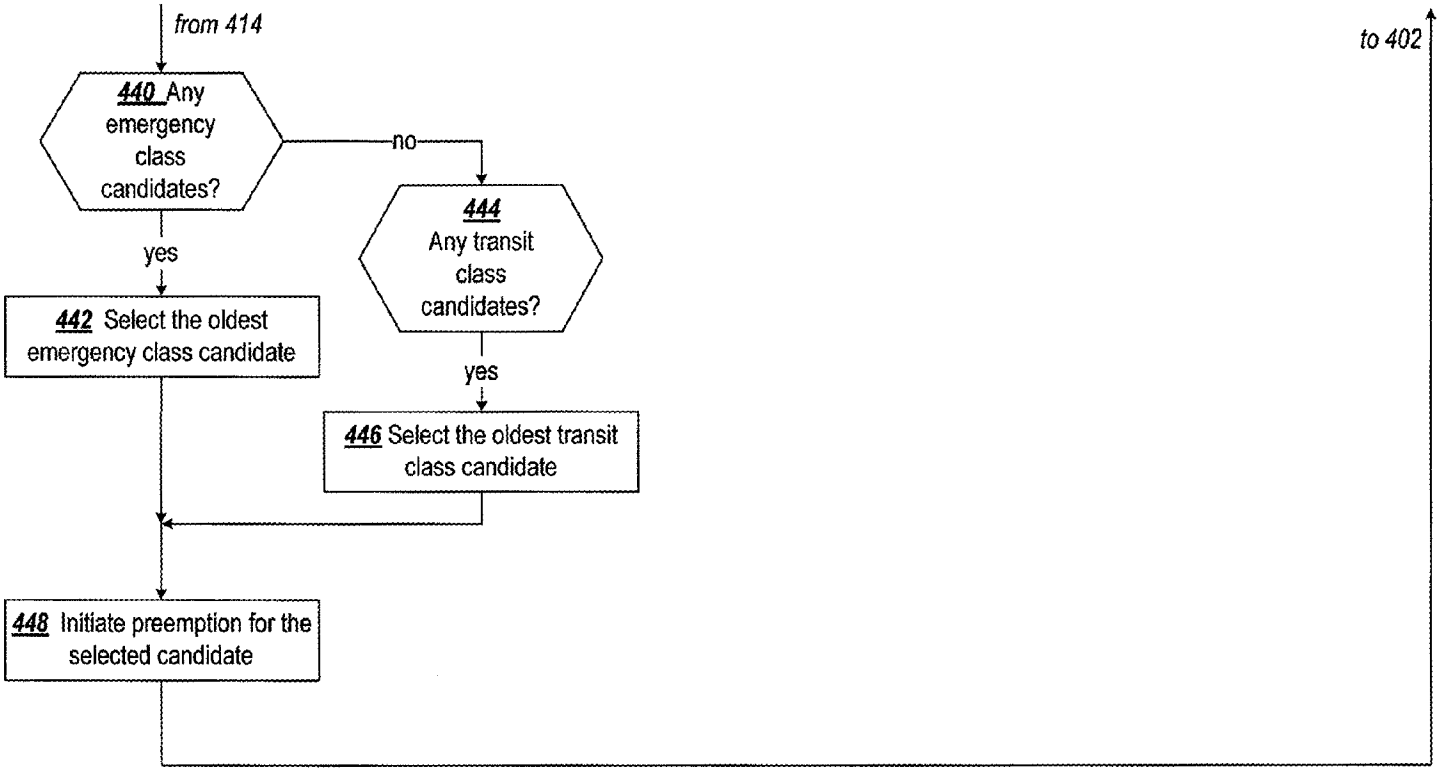

FIG. 4 shows the relationship between FIGS. 4-1, 4-2, and 4-3, which together from a flowchart of an example process for selecting one preemption candidate from multiple preemption candidates to preempt the traffic signal phase in accordance with an embodiment of the invention.

The process for selecting a preemption candidate considers a variety of factors in selecting a preemption candidate. Those factors include the relative priorities of the candidates, the relative times that the preemption requests were submitted, and the approaches of the preemption candidates relative to an in-progress preemption. The relative priorities are determined from a class code transmitted in the preemption request signal, and the process recognizes a superset of the class code ranges used in the different systems. For example, the OPTICOM light emitter-based system uses a class code range of 0 through 9, while the OPTICOM GPS system uses a class code range of 1 through 15. Additionally, the OPTICOM GPS system and compatible network based systems use an agency code to differentiate between agencies or jurisdictions. The agency code ranges in value from 1 through 254. The process recognizes a class code range of 0 through 15. Preemption requests with no agency code are assumed to have an agency code of 0. The combined set of class codes spans all agency codes so that vehicles using light-based emitters can compete with the same classes of vehicles from other agencies using GPS equipment.

Preemption candidates may be given preferential treatment based upon the class code. High priority vehicles typically used in public safety equipment may be separated by vehicle class such as police and fire or by vehicle type such ladder truck and pumper. In cases where both types of vehicles are present, the one with a higher priority relative to the other may take precedence over it. For example, fire trucks could be given a higher priority relative to police cars.

The process generally selects a preemption candidate on a first come, first served basis from one or more preemption candidates having the highest priority. Preemption candidates may be given preferential treatment based upon the approach the vehicle is travelling on. The preference may be given based on traffic flow whereby vehicles such as transit buses may be given preference during morning rush hour when traveling inbound to a city. A second type of preference, commonly called call bridging, is given when multiple vehicles are approaching the intersection from different directions. In this case, the first vehicle to become in range gains preemption. As it travels through the intersection, preference is given to any other vehicles that are within range and on the same approach in order to reduce switching of phases of the traffic signal.

Referring now to FIG. 4-1, decision step 402 tests whether or not the set of preemption candidates 312 is empty. If so, the process is directed to decision step 404 to check whether or not a preemption request is in progress. An in-progress preemption request is a request for which the intersection preemption arrangement 102 has activated and is maintaining a preemption request signal to the intersection controller 130. If there is no preemption in progress, the process returns to step 402. Otherwise, the process is directed to decision step 406, which checks whether or not the status of the in-progress preemption request is "holding." The hold status is used in combination with a hold timer. The hold timer is used to prevent an in-progress preemption request from being dropped too early, which without the hold timer could occur if a single broadcast is missed from the emitter/radio. The hold timer is also used to allow the vehicle time to clear the intersection at the end of the approach.

If the status of the in-progress preemption request is not holding, the status is changed to holding and the hold timer is started at step 408. The process then returns to step 402. If the status of the in-progress preemption request is holding decision step 410 checks whether or not the hold timer has expired. If not, the process returns to step 402. Otherwise, the preemption request is terminated and removed from the set of preemption candidates at step 412, with processing continuing at step 402.

If the set of preemption candidates is not empty, the process is directed to decision step 414 in FIGS. 4-2. Decision step 414 checks whether or not there is a preemption request in progress. If so, decision step 416 checks whether or not the in-progress preemption request is also in the preemption candidate set. Note that a preemption candidate is removed from the set when it is terminated or the intersection preemption arrangement is no longer receiving a preemption request signal for that preemption candidate. If the in-progress preemption request is in the preemption candidate set, the process proceeds to check whether or not the status of the preemption request is holding 418. If the status is not holding, step 420 changes the status to holding and starts the hold timer. Otherwise, decision step 422 checks whether or not the hold timer has expired. While the hold timer has not expired, the process continues at decision step 424 to check if there are any preemption candidates having a higher priority than the in-progress preemption request. In an example embodiment, the class codes of the preemption candidates are used to determine priorities. For example, a lesser class code value may be used to indicate a higher priority and a greater class code value may indicate a lower priority. If there is a higher priority candidate, the in-progress preemption request is terminated at step 426, and the process continues at step 440 in FIGS. 4-3.

If the hold timer for the in-progress preemption request has expired (decision step 422), decision step 428 checks whether or not there is any preemption candidate with an equal priority on the same approach as the in-progress preemption request. If not, the process continues at step 430 where the in-progress preemption request is terminated. If there is a preemption candidate with an equal priority on the same approach as the in-progress preemption request, the in-progress preemption request is terminated, and the oldest (based on the timestamp) equivalent priority preemption candidate is selected and made the in-progress preemption request at step 432. Note that the equivalence of priorities may vary according to implementation. For example, in one implementation the priority of preemption candidates may be equivalent only if the class codes are equal. In another embodiment, class code values within a group or range may be considered equivalent.

If the in-progress preemption candidate is in the set of preemption candidates (decision step 416), decision step 434 checks whether or not the status of the preemption request is holding. If not the process continues at step 424 as described above. Note that in step 426, if the terminated preemption request is in the set of preemption candidates, the termination further includes removing the preemption candidate from the set of preemption candidates. If the status of the preemption request is holding, decision step 436 checks whether or not the hold timer has expired. If not, the hold timer is cancelled as well as the hold status for the preemption request at step 438. The hold timer is used to allow a temporarily lost signal to be reacquired before the call is dropped. This provides some hysteresis around the signal acquisition for either noisy environments or weak signals. The reappearance of the preemption candidate causes the timer to be stopped to prevent dropping of the call. If the hold timer has expired, the in-progress preemption request is terminated and removed from the set of preemption candidates.

Continuing now at step 440 of FIG. 4-3, the process checks if any preemption candidate has a priority that indicates that the requesting vehicle is an emergency vehicle, for example, a fire or police vehicle. If there is such a candidate, the oldest one of those candidates is selected at step 442. If there are no emergency class vehicles, decision step 444 checks whether or not there is a preemption candidate that has a priority that indicates that the requesting vehicle is a transit class vehicle. If so, the oldest one of those candidates is selected at step 446. At step 448, the selected preemption candidate is initiated by activating the preemption request signal for the associated approach to the intersection controller. The process then returns to step 402 in FIG. 4-1.

Those skilled in the art will appreciate that the processes described herein may be provided via a variety of computer-readable storage media or delivery channels such as magnetic or optical disks or tapes, electronic storage devices, or as application services over a network.

The present invention is thought to be applicable to a variety of systems for controlling the flow of traffic. Other aspects and embodiments of the present invention will be apparent to those skilled in the art from consideration of the specification and practice of the invention disclosed herein. It is intended that the specification and illustrated embodiments be considered as examples only, with a true scope and spirit of the invention being indicated by the following claims.

What is claimed is:

1. A method for prioritizing multiple candidates for preemption of a traffic signal phase at an intersection, comprising:

receiving a respective light signal transmitted from one or more light-signaling vehicles approaching an intersection, each respective light signal encoding a priority code using a first set of values and representing a respective light-emitter-based preemption request;

receiving a respective radio signal from one or more radio-signaling vehicles approaching the intersection, each respective radio signal encoding respective location data and encoding a respective priority code using a second set of values, the encoded priority code representing a respective radio-transmitter-based preemption request;

adding a respective preemption candidate to a set of preemption candidates for each light-emitter-based preemption request;

adding a respective preemption candidate to the set of preemption candidates for each radio-transmitter-based preemption request;

determining a respective relative priority of each preemption candidate based on the priority code of each preemption candidate;

outputting a request for preemption of the traffic signal phase for a preemption candidate having a highest priority;

wherein the outputting of the request for preemption makes the preemption candidate in-progress;

iteratively checking the set of preemption candidates for a preemption candidate eligible for outputting for preemption of the traffic signal phase;

starting a hold timer and assigning a hold status to the in-progress preemption candidate in response to the in-progress preemption candidate not being in the candidate set in the checking step;

canceling the hold timer and hold status in response to the in-progress preemption candidate being in the candidate set in the checking step; and selecting a preemption candidate from the set of preemption candidates for outputting for preemption of the traffic signal phase in response to expiration of the hold timer.

2. The method of claim 1, further comprising:

receiving a respective message packet from one or more network-coupled vehicles approaching the intersection, each respective message packet encoding respective location data and encoding a respective priority code using the second set of values, the encoded priority code representing a respective network-packet-based preemption request; and adding a respective preemption candidate to the set of preemption candidates for each network-packet-based preemption request.

3. The method of claim 1, wherein:

the adding of the preemption candidate to the set of preemption candidates for each light-emitter-based preemption request includes determining for each of the one or more light-signaling vehicles whether or not the light-signaling vehicle is within a range of the intersection based on intensity of the respective light signal, and adding the preemption candidate to the set of preemption candidates in response to the light-signaling vehicle being within the range;

the adding of the preemption candidate to the set of preemption candidates for each radio-transmitter-based preemption request includes determining for each of the one or more radio-signaling vehicles whether or not the radio-signaling vehicle is within the range of the intersection based on the location data, and adding the preemption candidate to the set of preemption candidates in response to the radio-signaling vehicle being within the range.

4. The method of claim 3, further comprising:

receiving a respective message packet from one or more network-coupled vehicles approaching the intersection, each respective message packet encoding respective location data and encoding a respective priority code using the second set of values, the encoded priority code representing a respective network-packet-based preemption request; and determining for each of the one or more network-coupled vehicles whether or not the network-connected vehicle is within the range of the intersection based on the location data; and adding a respective preemption candidate to the set of preemption candidates for each network-packet-based preemption request.

5. The method of claim 3, further comprising:

wherein the outputting of the request for preemption makes the preemption candidate in-progress;

in response to the in-progress preemption candidate being for a light-signaling vehicle and further in response to determining that the light-signaling vehicle is not in range of the intersection, activating a timer and maintaining the preemption request in favor of the in-progress preemption candidate;

in response to the in-progress preemption candidate being from a radio-signaling vehicle and further in response to determining that the radio-signaling vehicle is not in range of the intersection, activating a timer and maintaining the preemption request in favor of the in-progress preemption candidate;

in response to expiration of the timer, terminating the in-progress preemption candidate.

6. The method of claim 5, further comprising:

receiving a respective message packet from one or more network-coupled vehicles approaching the intersection, each respective message packet encoding respective location data and encoding a respective priority code using the second set of values, the encoded priority code representing a respective network-packet-based preemption request; and in response to the in-progress preemption candidate being from a network-coupled vehicle and further in response to determining that the message packet-signaling vehicle is not in range of the intersection, activating a timer and maintaining the preemption request in favor of the in-progress preemption candidate.

7. The method of claim 5, further comprising:

wherein each preemption candidate is associated with an approach to the intersection for which a green phase of the traffic signal is requested; and in response to expiration of the timer and the in-progress preemption candidate and a second preemption candidate being associated with the same approach and the in-progress preemption candidate and the second preemption candidate having equivalent priorities, outputting a request for preemption of the traffic signal for the second preemption candidate.

8. The method of claim 1, further comprising:

wherein the preemption candidate is in progress in response to the outputting of the request for preemption; and in response to a first preemption candidate being in progress and a second preemption candidate in the set having a higher priority than the first preemption candidate, terminating the first preemption candidate and outputting a request for preemption of the traffic signal for the second preemption candidate.

9. The method of claim 1, further comprising:

receiving a respective message packet from one or more network-coupled vehicles approaching the intersection, each respective message packet encoding respective location data and encoding a respective priority code using the second set of values, the encoded priority code representing a respective network-packet-based preemption request;

adding a respective preemption candidate to the set of preemption candidates for each network-packet-based preemption request;

wherein the preemption candidate is in progress in response to the outputting of the request for preemption; and in response to a first preemption candidate being in progress and a second preemption candidate in the set having a higher priority than the first preemption candidate, terminating the first preemption candidate and outputting a request for preemption of the traffic signal for the second preemption candidate.

10. The method of claim 1, further comprising:

wherein the preemption candidate is in progress in response to the outputting of the request for preemption; and in response to a first preemption candidate being in progress and two or more preemption candidates in the set having higher priorities than the first preemption candidate, terminating the first preemption candidate, selecting an oldest one of the two or more preemption candidates, and outputting a request for preemption of the traffic signal for the oldest one of the preemption candidates.

11. The method of claim 1, further comprising:

receiving a respective message packet from one or more network-coupled vehicles approaching the intersection, each respective message packet encoding respective location data and encoding a respective priority code using the second set of values, the encoded priority code representing a respective network-packet-based preemption request;

adding a respective preemption candidate to the set of preemption candidates for each network-packet-based preemption request;

wherein the preemption candidate is in progress in response to the outputting of the request for preemption; and in response to a first preemption candidate being in progress and two or more preemption candidates in the set having higher priorities than the first preemption candidate, terminating the first preemption candidate, selecting an oldest one of the two or more preemption candidates, and outputting a request for preemption of the traffic signal for the oldest one of the preemption candidates.

12. The method of claim 1, wherein the first set of values is different from the second set of values.

13. A traffic signal preemption control system, comprising:

photo-detector circuitry for receiving a respective light signal transmitted from one or more light-signaling vehicles approaching an intersection, each respective light signal encoding a priority code using a first set of values and representing a respective light-emitter-based preemption request;

a radio signal receiver for receiving a respective radio signal from one or more radio-signaling vehicles approaching the intersection, each respective radio signal encoding respective location data and encoding a respective priority code using a second set of values, the encoded priority code representing a respective radio-transmitter-based preemption request;

a processor coupled to the photo-detector circuitry and to the radio signal receiver; and a memory coupled to the processor, wherein the memory is configured with instructions for programming the processor to perform the operations including:

adding a respective preemption candidate to a set of preemption candidates for each light-emitter-based preemption request;

adding a respective preemption candidate to the set of preemption candidates for each radio-transmitter-based preemption request;

determining a respective relative priority of each preemption candidate based on the priority code of each preemption candidate;

outputting a request for preemption of the traffic signal phase for a preemption candidate having a highest priority;

wherein the outputting of the request for preemption makes the preemption candidate in-progress;

iteratively checking the set of preemption candidates for a preemption candidate eligible for outputting for preemption of the traffic signal phase;

starting a hold timer and assigning a hold status to the in-progress preemption candidate in response to the in-progress preemption candidate not being in the candidate set in the checking step;

canceling the hold timer and hold status in response to the in-progress preemption candidate being in the candidate set in the checking step; and selecting a preemption candidate from the set of preemption candidates for outputting for preemption of the traffic signal phase in response to expiration of the hold timer.

14. The system of claim 13, further comprising:

a network interface coupled to the processor, the network interface configured to receive a respective message packet from one or more network-coupled vehicles approaching the intersection, each respective message packet encoding respective location data and encoding a respective priority code using the second set of values, the encoded priority code representing a respective network-packet-based preemption request; and wherein the memory is further configured with instructions for programming the processor to perform the operation of adding a respective preemption candidate to the set of preemption candidates for each network-packet-based preemption request.

15. The system of claim 14, wherein:

the adding of the preemption candidate to the set of preemption candidates for each light-emitter-based preemption request includes determining for each of the one or more light-signaling vehicles whether or not the light-signaling vehicle is within a range of the intersection based on intensity of the respective light signal, and adding the preemption candidate to the set of preemption candidates in response to the light-signaling vehicle being within the range;

the adding of the preemption candidate to the set of preemption candidates for each radio-transmitter-based preemption request includes determining for each of the one or more radio-signaling vehicles whether or not the radio-signaling vehicle is within the range of the intersection based on the location data, and adding the preemption candidate to the set of preemption candidates in response to the radio-signaling vehicle being within the range; and the adding of the respective preemption candidate to the set of preemption candidates for each network-packet-based preemption request includes determining for each of the one or more network-coupled vehicles whether or not the network connected vehicle is within the range of the intersection based on the location data, and adding the preemption candidate to the set of preemption candidates in response to the network-coupled vehicle being within the range.

16. The system of claim 14, further comprising:

wherein the outputting of the request for preemption makes the preemption candidate in-progress;

wherein the memory is further configured with instructions for programming the processor to perform the operations including:

in response to the in-progress preemption candidate being for a light-signaling vehicle and further in response to determining that the light-signaling vehicle is not in range of the intersection, activating a timer and maintaining the preemption request in favor of the in-progress preemption candidate;

in response to the in-progress preemption candidate being from a radio-signaling vehicle and further in response to determining that the radio-signaling vehicle is not in range of the intersection, activating a timer and maintaining the preemption request in favor of the in-progress preemption candidate;

in response to the in-progress preemption candidate being from a network-coupled vehicle and further in response to determining that the message packet-signaling vehicle is not in range of the intersection, activating a timer and maintaining the preemption request in favor of the in-progress preemption candidate; and in response to expiration of the timer, terminating the in-progress preemption candidate.

17. The system of claim 13, further comprising:

wherein each preemption candidate is associated with an approach to the intersection for which a green phase of the traffic signal is requested; and the memory is further configured with instructions for programming the processor to perform the operation of outputting, in response to expiration of the timer and the in-progress preemption candidate and a second preemption candidate being associated with the same approach and the in-progress preemption candidate and the second preemption candidate having equivalent priorities, a request for preemption of the traffic signal for the second preemption candidate.

18. The system of claim 13, further comprising:

wherein the preemption candidate is in progress in response to the outputting of the request for preemption;

wherein the adding of the respective preemption candidate to the set of preemption candidates for each light-emitter-based preemption request and the adding of the respective preemption candidate to the set of preemption candidates for each radio-transmitter-based preemption request is repeated for newly received light and radio signals; and the memory is further configured with instructions for programming the processor to perform the operation of terminating, in response to a first preemption candidate being in progress and a second preemption candidate in the set having a higher priority than the first preemption candidate, the first preemption candidate and outputting a request for preemption of the traffic signal for the second preemption candidate.

19. The system of claim 13, further comprising:

wherein the preemption candidate is in progress in response to the outputting of the request for preemption;

wherein the adding of the respective preemption candidate to the set of preemption candidates for each light-emitter-based preemption request and the adding of the respective preemption candidate to the set of preemption candidates for each radio-transmitter-based preemption request is repeated for newly received light and radio signals; and the memory is further configured with instructions for programming the processor to perform the operation of terminating, in response to a first preemption candidate being in progress and two or more preemption candidates in the set having higher priorities than the first preemption candidate, the first preemption candidate, selecting an oldest one of the two or more preemption candidates, and outputting a request for preemption of the traffic signal for the oldest one of the preemption candidates.

* * * * *